US012453424B2

(12) United States Patent
Liu et al.

(10) Patent No.: US 12,453,424 B2
(45) Date of Patent: Oct. 28, 2025

(54) INTELLIGENT SAUCER AND FURNITURE

(71) Applicant: Suzhou Zhiwei Microelectronics Co., Ltd, Suzhou (CN)

(72) Inventors: Xinyao Liu, Suzhou (CN); Xiang Wang, Suzhou (CN)

(73) Assignee: Suzhou Zhiwei Microelectronics Co., Ltd, Suzhou (CN)

( * ) Notice: Subject to any disclaimer, the term of this patent is extended or adjusted under 35 U.S.C. 154(b) by 4 days.

(21) Appl. No.: 18/419,819

(22) Filed: Jan. 23, 2024

(65) Prior Publication Data

US 2025/0072624 A1 Mar. 6, 2025

(30) Foreign Application Priority Data

Sep. 1, 2023 (CN) ..... 202311125702.8

(51) Int. Cl.
*A47C 17/86* (2006.01)
*A47G 19/22* (2006.01)

(52) U.S. Cl.
CPC ..... *A47C 17/86* (2013.01); *A47G 19/2283* (2013.01)

(58) Field of Classification Search
CPC ..... A47C 17/86; A47C 7/622; A47C 7/72; A47C 7/744; A47G 19/2283
See application file for complete search history.

*Primary Examiner* — Andrew D Perreault
(74) *Attorney, Agent, or Firm* — ZIEGLER IP LAW GROUP, LLC.

(57) ABSTRACT

An intelligent saucer and furniture are provided. The intelligent saucer includes a cup barrel, a cup frame, a wireless charging assembly, a refrigeration assembly, and a control unit electrically connected to the wireless charging assembly and the refrigeration assembly respectively. The cup frame includes a frame body fixedly connected to the cup barrel, a roller rotatably arranged on and partially exposed outside the frame body, and a baffle plate is slidably fitted with the frame body. Within a movement stroke, the baffle plate has a first operating state of exposing the roller, and a second operating state of sheltering the roller. The wireless charging assembly and the control unit are fixed in the frame body. The refrigeration assembly is fixed at one side of the frame body away from the cup barrel, and corresponding to the cup barrel. An encoder on the control unit is rotatably connected to the roller.

20 Claims, 6 Drawing Sheets

INTELLIGENT SAUCER AND FURNITURE

CROSS REFERENCE TO RELATED APPLICATIONS

The present disclosure claims priority to the Chinese patent application with the filing No. 2023111257028 filed with the China National Intellectual Property Administration on Sep. 1, 2023, and entitled "Intelligent Saucer and Furniture", the contents of which are incorporated herein by reference in entirety.

TECHNICAL FIELD

The present disclosure relates to the technical field of intelligent furniture, particularly to an intelligent saucer and furniture.

BACKGROUND ART

Sitting furniture such as sofa and massage chair is usually provided with a saucer at an armrest part. The saucer can carry a cup. By means of keys on the saucer, functions such as cooling the cup and controlling on and off of the furniture can be achieved. Through a charging port on the saucer, electronic devices can also be charged.

The existing saucers have many keys, which makes it hard for users to distinguish. Moreover, the keys and the charging port on the existing saucers are usually directly arranged on a surface of the saucer, and then unintended activation is prone to occur when taking the cup, thereby degrading user experience. Moreover, liquids and dust are very likely to enter the interior of the saucer from gaps of the keys or the charging port, further causing damages to electronic components inside the saucer.

SUMMARY

In order to overcome the shortcomings in the prior art, the present disclosure provides an intelligent saucer and furniture.

The present disclosure provides the following technical solutions.

In a first aspect, the present disclosure provides an intelligent saucer, including:

a cup barrel;

a cup frame, including a frame body, a roller, and a baffle plate (sheltering plate), wherein the frame body is fixedly connected to the cup barrel; the roller is rotatably arranged on the frame body, and the roller is partially exposed outside the frame body; the baffle plate is slidably fitted with the frame body; and the baffle plate has, within a movement stroke, a first operating state of exposing the roller, and a second operating state of sheltering the roller;

a wireless charging assembly, fixed in the frame body;

a refrigeration assembly, fixed at one side of the frame body away from the cup barrel, and corresponding to the cup barrel; and a control unit, fixed in the frame body, and electrically connected to the wireless charging assembly and the refrigeration assembly respectively, wherein an encoder on the control unit is rotatably connected to the roller.

In a possible embodiment, the frame body includes a placement portion and a control portion connected to each other; an accommodating cavity is provided in the placement portion, and the cup barrel is fixed in the accommodating cavity; the roller is rotatably provided on the control portion, and the baffle plate is slidably fitted with the control portion.

In a possible embodiment, a first slide strip and a second slide strip are respectively provided on the control portion; a first movement portion and a second movement portion are disposed at two sides of the baffle plate, respectively; and the first movement portion is slidably fitted with the first slide strip, and the second movement portion is slidably fitted with the second slide strip.

In a possible embodiment, one end of the control portion away from the placement portion is provided with a rolling groove; and the roller is rotatably disposed in the rolling groove, and the roller is partially exposed outside the rolling groove.

In a possible embodiment, the end of the control portion away from the placement portion is provided with a slot, and the slot is corresponding to a charging jack on the control unit.

In a possible embodiment, the intelligent saucer further includes a first light-emitting assembly and a second light-emitting assembly; a first mounting groove and a second mounting groove are respectively provided on the frame body; the first light-emitting assembly is fixed in the first mounting groove, and the second light-emitting assembly is fixed in the second mounting groove; the baffle plate is located between the first light-emitting assembly and the second light-emitting assembly; and the control unit is electrically connected to the first light-emitting assembly, the second light-emitting assembly, and the wireless charging assembly, respectively.

In a possible embodiment, the intelligent saucer cup frame further includes a surface shell and a light guide bar; the surface shell is fixedly connected to the frame body; the light guide bar is provided between the surface shell and the frame body; and the control unit is electrically connected to the light guide bar and the refrigeration assembly respectively.

In a possible embodiment, one end of the baffle plate close to the cup barrel is provided with a fitting portion corresponding to a peripheral shape of the surface shell; and the surface shell is provided thereon with a limiting portion corresponding to the fitting portion.

In a possible embodiment, the intelligent saucer further includes a first pressing block and a second pressing block; a connection portion of the light guide bar is fixed between the first pressing block and the second pressing block; and the second pressing block is fixedly connected to the control unit.

In a second aspect, the present disclosure further provides a kind of furniture, including the above intelligent saucer.

Compared with the prior art, the present disclosure has the following beneficial effects:

according to the intelligent saucer provided in the present disclosure, a cup is carried by the cup barrel; and the refrigeration assembly can cool the cup in the cup barrel. The baffle plate can carry an electronic product, and the wireless charging assembly can wirelessly charge the electronic product. By rotating the roller, the encoder on the control unit can convert angular displacement of the roller into a corresponding electrical signal, so that the control unit controls the operation of the wireless charging assembly or the refrigeration assembly and the sofa or massage chair. The baffle plate, slidably fitted with the frame body, can expose the roller in the first operating state, so as to facilitate the rotation of the roller; and the baffle plate can also shelter the roller in the second operating state, so as to prevent liquids and dust from entering the interior of the frame body, and avoid unintended activation of the roller. With the intelligent saucer of the present disclosure, different functional assemblies can be controlled to operate, by rotating the roller, so that the operation is simple, and the users' use experience can be effectively improved.

In order to make the above objectives, features, and advantages of the present disclosure clearer and more understandable, detailed descriptions are made below with specific reference to preferred embodiments and drawings attached.

BRIEF DESCRIPTION OF DRAWINGS

In order to more clearly illustrate technical solutions of embodiments of the present disclosure, drawings which need to be used in the embodiments will be introduced briefly below. It should be understood that the drawings below merely show some embodiments of the present disclosure, therefore, they should not be considered as limitation to the scope. Those ordinarily skilled in the art still could obtain other relevant drawings according to these drawings, without paying any inventive efforts.

REFERENCE SIGNS OF MAIN ELEMENTS

Figure 1:
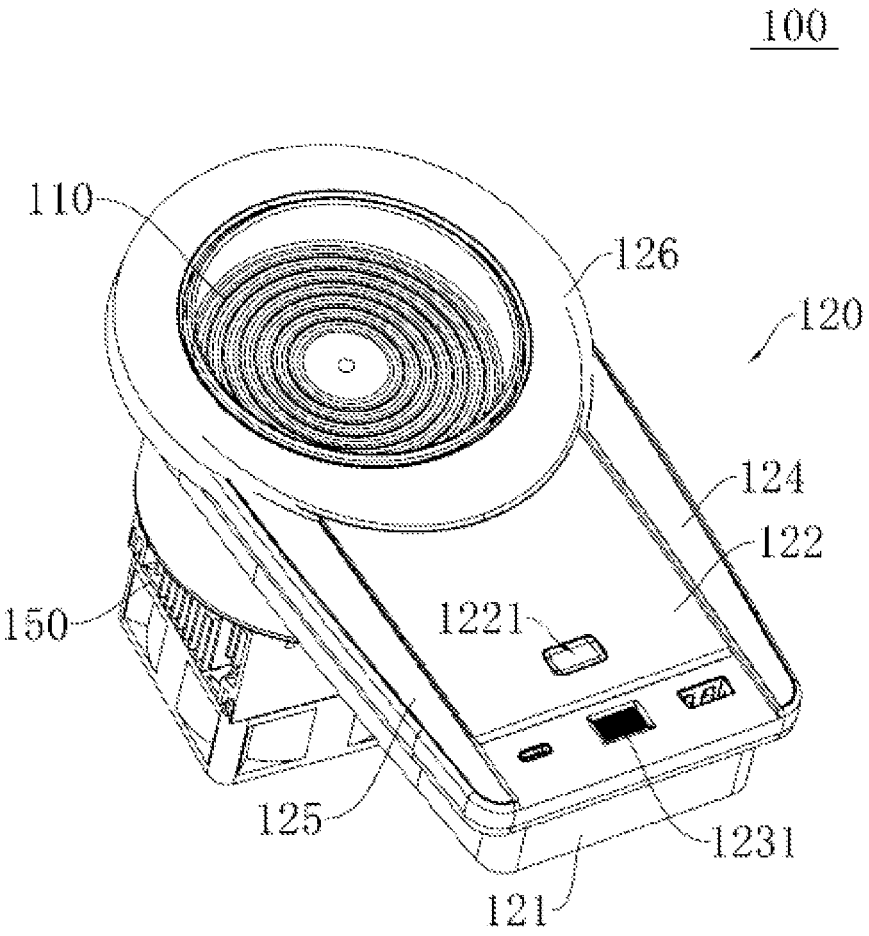
FIG. 1 shows a schematic diagram of a baffle plate, in a first operating state, of an intelligent saucer according to an embodiment of the present disclosure.

100—intelligent saucer; 110—cup barrel; 111—carrying plate; 120—cup frame; 121—frame body; 1211—placement portion; 1212—control portion; 12121—first fixing part; 12122—second fixing part; 12123—first slide strip; 12124—second slide strip; 12125—first mounting groove; 12126—second mounting groove; 12127—rolling groove; 12128—slot; 12129—partition plate; 122—baffle plate; 1221—movement groove; 1222—first movement portion; 1223—second movement portion; 1224—fitting portion; 123—rolling assembly; 1231—roller; 1232—rotating shaft; 1233—fixing seat; 124—first light-emitting assembly; 1241—first lamp panel; 1242—first light shield element; 1243—first decorative element; 125—second light-emitting assembly; 1251—second lamp panel; 1252—second light shield element; 1253—second decorative element; 126—surface shell; 1261—limiting portion; 127—light guide bar; 1271—first pressing block; 1272—second pressing block; 128—back cover; 1281—first crimping block; 1282—second crimping block; 129—bottom shell; 1291—heat sink; 130—control unit; 139—encoder; 140—wireless charging assembly; 141—charging coil; 142—fixing block; 150—refrigeration assembly; 151—heat dissipation element; 152—exhaust fan; 153—mounting part; 160—mounting seat.

DETAILED DESCRIPTION OF EMBODIMENTS

The embodiments of the present disclosure are described in detail below. Examples of the embodiments are shown in the drawings, in which same or similar reference signs represent same or similar elements or elements having same or similar functions throughout. The embodiments described below with reference to the drawings are exemplary, merely for explaining the present disclosure, but should not be construed as limitation to the present disclosure.

In the description of the present disclosure, it should be understood that orientation or positional relationships indicated by the terms such as "center", "longitudinal", "lateral", "length", "width", "thickness", "upper", "lower", "front", "back", "left", "right", "vertical", "horizontal", "top", "bottom", "inner", "outer", "clockwise", "anticlockwise", "axial", "radial", and "circumferential" are based on orientation or positional relationships shown in the drawings, merely for facilitating in describing the present disclosure and simplifying the description, rather than indicating or implying that referred devices or elements must be in a particular orientation or constructed or operated in the particular orientation, and therefore, they should not be construed as limitation to the present disclosure.

In addition, the terms "first" and "second" are used for descriptive purposes only, but should not be construed as an indication or implication of importance in the relativity or an implicit indication of the number of the referred technical features. Thus, for a feature defined with the terms "first" and "second", one or more such features may be included explicitly or implicitly. In the description of the present disclosure, "multiple (a plurality of)" means two or more, unless otherwise explicitly defined.

In the present disclosure, unless otherwise explicitly specified and defined, terms such as "mount", "link", "connect", and "fix" should be construed in a broad sense. For example, a connection may be a fixed connection, a detachable connection, or an integral connection; it may be a mechanical connection, and also may be an electrical connection; it may be a direct connection, an indirect connection via an intermediary, or internal communication between two elements or interaction between two elements. For those ordinarily skilled in the art, specific meanings of the above terms in the present disclosure could be understood according to specific circumstances.

In the present disclosure, unless otherwise explicitly specified and defined, the expression that a first feature is "on" or "under" a second feature could be construed in such a way that the first feature and the second feature are in direct contact, or the first feature and the second feature are in indirect contact via an intermediary. Moreover, a first feature being "on", "over", and "above" a second feature may include a case where the first feature is directly above or not directly above (obliquely above) the second feature, or merely indicates that the first feature is horizontally higher than the second feature. The first feature being "under", "beneath", and "below" a second feature may include a case where the first feature is directly below or not directly below (obliquely below) the second feature, or merely indicates that the first feature is horizontally lower than the second feature.

Embodiment 1

Referring to FIG. 1 to FIG. 9, an embodiment of the present disclosure provides an intelligent saucer 100. The intelligent saucer 100 is used in furniture.

The intelligent saucer 100 includes a cup barrel 110, a cup frame 120, a wireless charging assembly 140, a refrigeration assembly 150, and a control unit 130. The cup frame 120 includes a frame body 121, a roller 1231, and a baffle plate 122. The frame body 121 is fixedly connected to the cup barrel 110. The roller 1231 is rotatably arranged on the frame body 121, and the roller 1231 is partially exposed outside the frame body 12. The baffle plate 122 is slidably fitted with the frame body 121. Within a movement stroke, the baffle plate 122 has a first operating state of exposing the roller 1231, and a second operating state of sheltering the roller 1231. The wireless charging assembly 140 is fixed in the frame body 121. The refrigeration assembly 150 is fixed at one side of the frame body 121 away from the cup barrel 110, and is corresponding to the cup barrel 110. The control unit 130 is fixed in the frame body 121, and is electrically connected to the wireless charging assembly 140 and the refrigeration assembly 150 respectively. An encoder 139 on the control unit 130 is rotatably connected to the roller 1231.

The cup barrel 110 is configured to carry a cup. The refrigeration assembly 150 is configured to cool the cup in the cup barrel 110. The baffle plate 122 can carry an electronic product. The wireless charging assembly 140 is configured to charge the electronic product wirelessly. By rotating the roller 1231, the encoder 139 on the control unit 130 can convert angular displacement of the roller 1231 into a corresponding electrical signal, so that the control unit 130 controls the refrigeration assembly 150 or the wireless charging assembly 140 to operate. The baffle plate 122 is slidably fitted with the frame body 121, and can expose the roller 1231 in the first operating state so as to facilitate rotation of the roller 1231, and also can shelter the roller 1231 in the second operating state so as to prevent liquids and dust from entering the interior of the frame body 121, and avoid unintended activation of the roller 1231.

Referring to FIG. 1 to FIG. 5, the frame body 121 includes a placement portion 1211 and a control portion 1212 connected to each other. An accommodating cavity corresponding to the cup barrel 110 is provided in the placement portion 1211. The cup barrel 110 is fixed in the accommodating cavity. The baffle plate 122 is slidably fitted with the control portion 1212. The baffle plate 122 can gradually expose the roller 1231 when moving towards the placement portion 1211.

Figure 4:
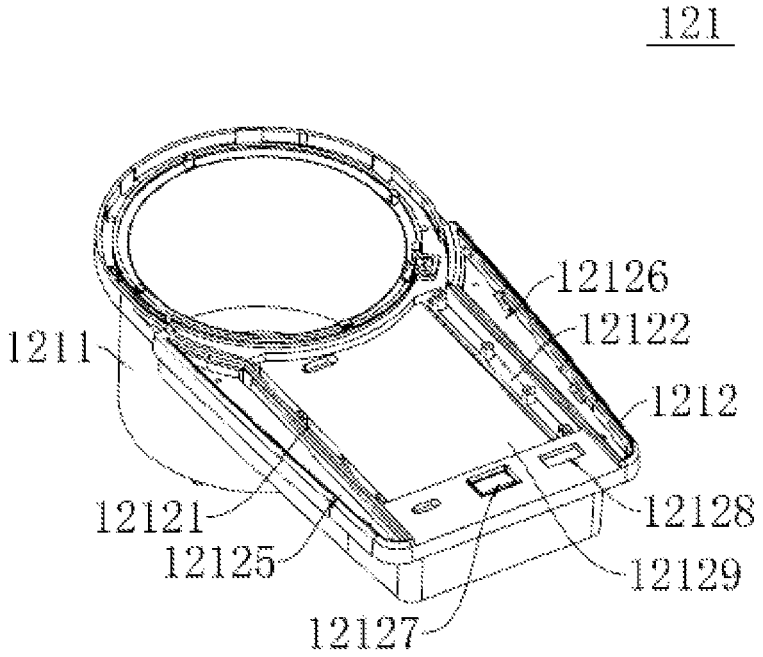
FIG. 4 shows a schematic perspective structural diagram of a frame body according to an embodiment of the present disclosure.
Figure 5:
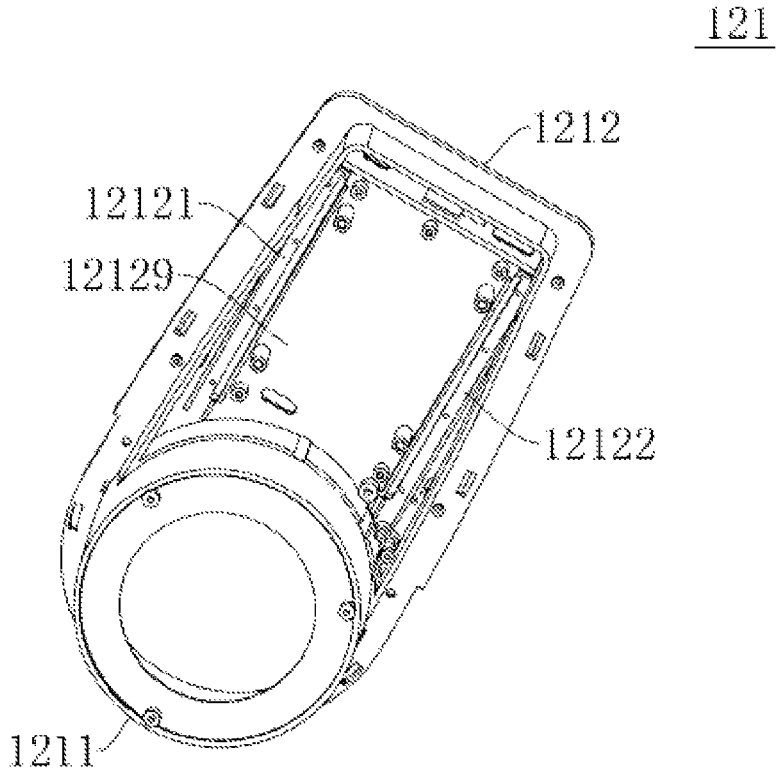
FIG. 5 shows a schematic perspective structural diagram of the frame body according to an embodiment of the present disclosure, from another angle.

In some embodiments, with reference to FIGS. 4-5, a partition plate 12129 is disposed inside the control portion 1212, so as to separate a space inside the control portion 1212 into a first region and a second region, wherein the first region is located above the second region. The baffle plate 122 is movably provided in the first region.

A first fixing part 12121 and a second fixing part 12122 are respectively provided at two sides of the partition plate 12129. A first connection groove is formed between the partition plate 12129 and the first fixing part 12121. A second connection groove is formed between the partition plate 12129 and the second fixing part 12122.

The intelligent saucer 100 further includes a first slide strip 12123 and a second slide strip 12124. The first slide strip 12123 and the second slide strip 12124 are both disposed in the second region. The first slide strip 12123 is fixed on the first fixing part 12121, and the second slide strip 12124 is fixed on the second fixing part 12122.

Specifically, the first slide strip 12123 and the second slide strip 12124 are disposed in parallel, and both face the placement portion 1121. The first slide strip 12123 and the second slide strip 12124 are fixed on corresponding fixing parts by screws.

A first movement portion 1222 and a second movement portion 1223 are disposed at two sides of the baffle plate 122, respectively. One end of the first movement portion 1222 passes through the first connection groove and is slidably fitted with the first slide strip 12123, and one end of the second movement portion 1223 passes through the second connection groove and is slidably fitted with the second slide strip 12124, thereby limiting a moving direction of the baffle plate 122.

Referring to FIG. 1 and FIG. 4, in some embodiments, one end of the control portion 1212 away from the placement portion 1211 is provided with a rolling groove 12127. The roller 1231 is rotatably disposed in the rolling groove 12127, and the roller 1231 is partially exposed outside the rolling groove 12127.

Further, the rolling groove 12127 is a concave groove for exposing the roller 1231 easily.

In some embodiments, the end of the control portion 1212 away from the placement portion 1211 is provided with a slot 12128. The slot 12128 is corresponding to a charging jack on the control unit 130, so that a charging cable plug of an electronic device is connected to the charging jack, thereby charging the electronic device in a wired way.

The charging jack may be a USB interface, a type-c interface, or other interfaces. An operator may adjust the number and arrangement positions of the charging jacks as actually needed.

Figure 2:
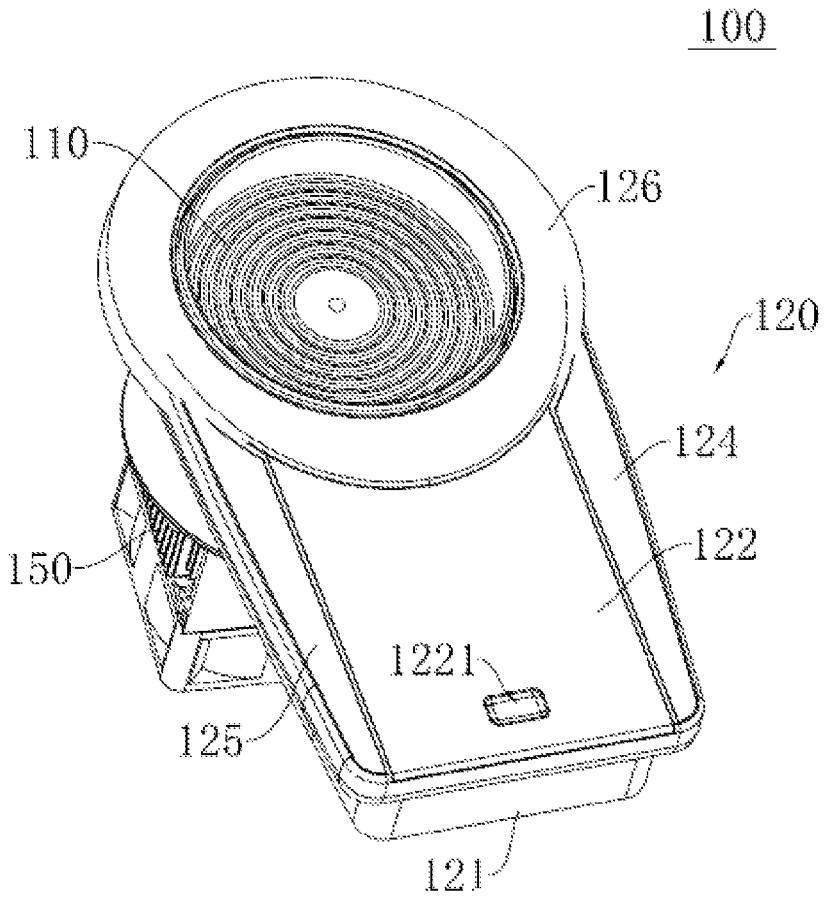
FIG. 2 shows a schematic diagram of the baffle plate, in a second operating state, of the intelligent saucer according to an embodiment of the present disclosure.

Referring to FIG. 1 and FIG. 2, an upper surface of the baffle plate 122 is provided with a movement groove 1221, so as to facilitate a user in driving the baffle plate 122 to move.

Figure 3:
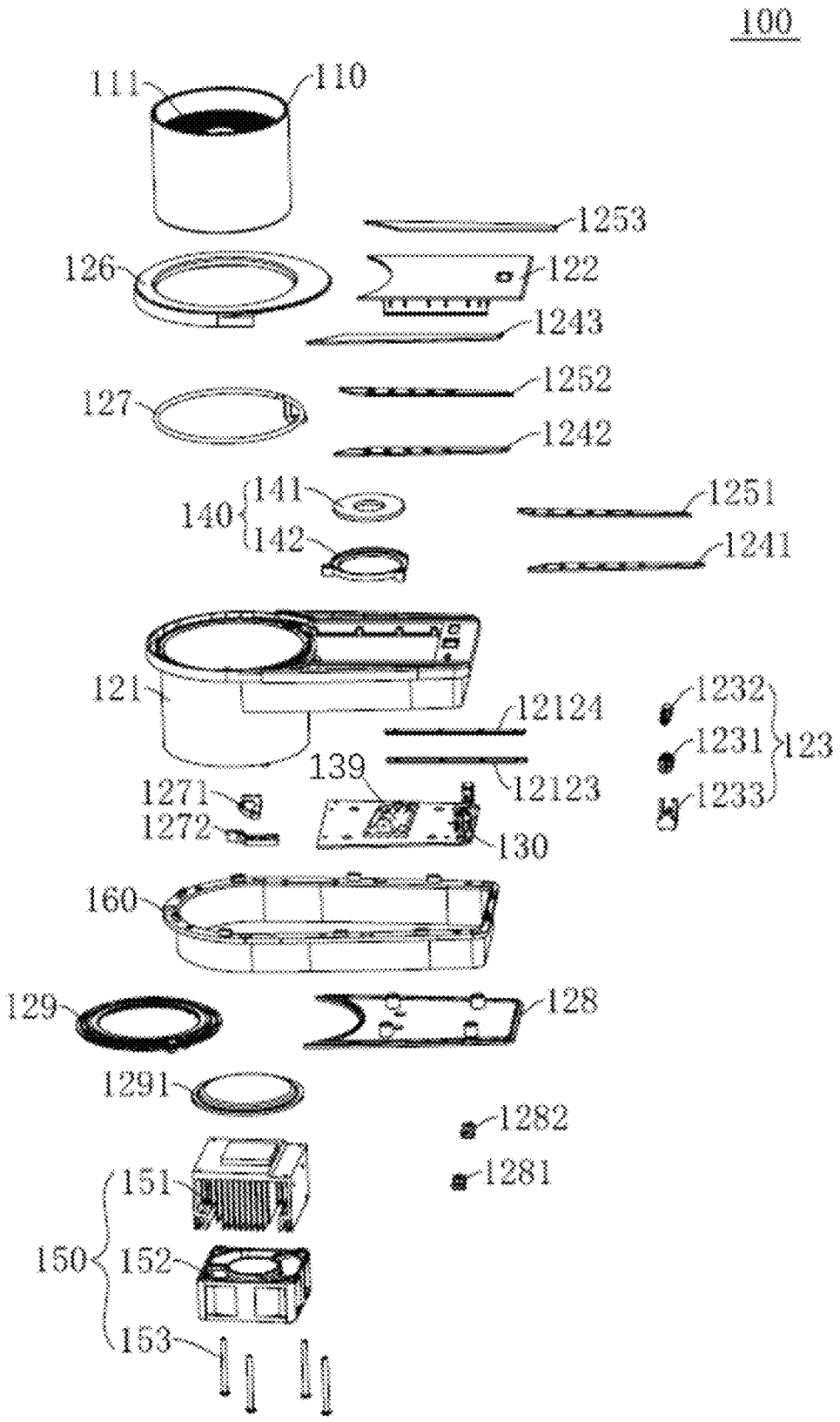
FIG. 3 shows a schematic explosive view of the intelligent saucer according to an embodiment of the present disclosure.
Figure 6:
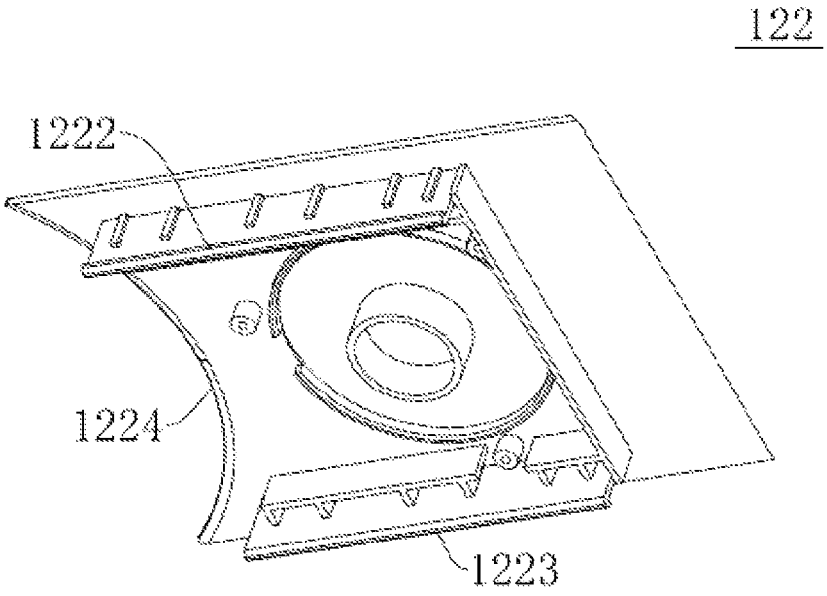
FIG. 6 shows a schematic perspective structural diagram of the baffle plate according to an embodiment of the present disclosure.

Referring to FIG. 3, FIG. 4, and FIG. 6, the wireless charging assembly 140 is disposed above the partition plate 12129. The wireless charging assembly 140 includes a charging coil 141 and a fixing block 142. The baffle plate 122 is provided with a mounting portion for mounting the charging coil 141. The fixing block 142 is fixedly connected to one side of the baffle plate 122. The charging coil 141 is arranged between the baffle plate 122 and the fixing block 142, so that the charging coil 141 is mounted inside the mounting portion.

The wireless charging assembly 140 wirelessly charges the electronic device placed on the baffle plate 122, by means of electromagnetic induction.

Referring to FIG. 3 and FIG. 4, the control unit 130 is provided inside the control portion 1212, and located below the partition plate 12129.

The control unit 130 is a PCB (printed circuit board) control board.

The intelligent saucer 100 further includes a rolling assembly 123. In addition to the roller 1231, the rolling assembly 123 further includes a rotating shaft 1232 and a fixing seat 1233. The rotating shaft 1232 is fixedly connected to the roller 1231. One end of the rotating shaft 1232 is rotatably arranged on the fixing seat 1233 by a bearing, and is rotatably connected to the encoder 139 on the control unit 130. The fixing seat 1233 is fixed on the control unit 130.

The control unit 130 is electrically connected to a key switch. By pressing down the roller 1231 when the roller 1231 is rotated to a certain angle, the roller 1231 can drive one end of the rotating shaft 1232 away from the encoder 139 to move downwards, so as to touch the key switch and further control on or off of a corresponding functional assembly.

Referring to FIG. 1 to FIG. 5, the intelligent saucer 100 further includes a first light-emitting assembly 124 and a second light-emitting assembly 125. The first light-emitting assembly 124 and the second light-emitting assembly 125 are respectively fixed at two sides of the control portion 122. The baffle plate 122 is located between the first light-emitting assembly 124 and the second light-emitting assembly 125. Both the first light-emitting assembly 124 and the second light-emitting assembly 125 are electrically connected to the control unit 130. When the roller 1231 is rotated to a first preset angle, the control unit 130 can control the first light-emitting assembly 124 and the second light-emitting assembly 125 to light up simultaneously, in which case by pressing the roller 1231 downwards, on or off of the wireless charging assembly 140 can be controlled.

A first mounting groove 12125 and a second mounting groove 12126 are respectively provided at two sides of the control portion 1212. The first light-emitting assembly 124 is fixed inside the first mounting groove 12125. The second light-emitting assembly 125 is fixed inside the second mounting groove 12126.

The first light-emitting assembly 124 includes a first lamp panel 1241, a first light shield element 1242, and a first decorative element 1243. The first light shield element 1242 is arranged between the first lamp panel 1241 and the first decorative element 1243. The first lamp panel 1241 is fixed inside the first mounting groove 12125. The first lamp panel 1241 is electrically connected to the control unit 130.

The first light shield element 1242 is configured to limit a light path of the first lamp panel 1241, so as to adjust a propagation direction of an optical path. The first decorative element 1243 is made of acrylic material, so as to protect the first light shield element 1242 and the first lamp panel 1241 and achieve a decorative effect. The first lamp panel 1241 is fixed inside the first mounting groove 12125 by screw(s).

The second light-emitting assembly 125 includes a second lamp panel 1251, a second light shield element 1252, and a second decorative element 1253. The second light shield 1252 is arranged between the second lamp panel 1251 and the second decorative element 1253. The second lamp panel 1251 is fixed inside the second mounting groove 12126. The second lamp panel 1251 is electrically connected to the control unit 130.

Figure 7:
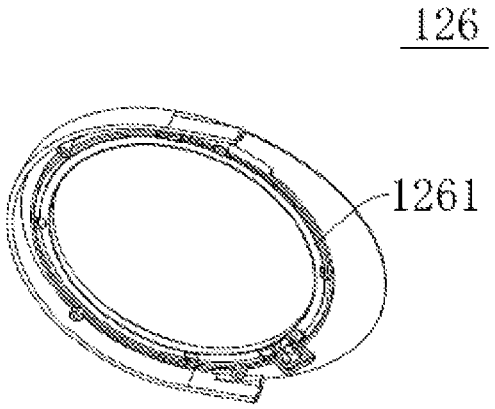
FIG. 7 shows a schematic perspective structural diagram of a surface shell according to an embodiment of the present disclosure.

Referring to FIG. 4 and FIG. 7, the cup frame 120 further includes a surface shell 126. The surface shell 126 is fixedly connected to the placement portion 1121 through a snap-fitting structure, so that the cup barrel 110 is fixed inside the accommodating cavity of the control portion 1212.

With reference to FIG. 6, one end of the baffle plate 122 close to the cup barrel 110 is provided with a fitting portion 1224 corresponding to a peripheral shape of the surface shell 126. The surface shell 126 is provided thereon with a limiting portion 1261 corresponding to the fitting portion 1224, and the limiting portion 1261 is configured to limit movement of the baffle plate 122.

Referring to FIG. 1, when the baffle plate 122 moves towards the surface shell 126, the fitting portion 1224 can abut against the limiting portion 1261, so as to limit the movement of the baffle plate 122.

Referring to FIG. 2, when the baffle plate 122 moves away from the surface shell 126, and the first movement portion 1222 and the second movement portion 1223 abut against an end of the control portion 1212, the baffle plate 122 stops moving, in which case a position where the fitting portion 1224 is located is corresponding to a position of a periphery of the surface shell 126.

Referring to FIG. 3 and FIG. 5, the cup frame 120 further includes a back cover 128. The back cover 128 seals an opening at the bottom of the frame body 121. A first crimping block 1281 and a second crimping block 1282 are respectively fixed at a side of the back cover 128 away from the frame body 121. The first crimping block 1281 and the second crimping block 1282 are configured to fix wires of the refrigeration assembly 150, so that the wire(s) of the refrigeration assembly 150 passes through the back cover 128 and is connected to the control unit 130.

The control unit 130 is fixedly connected to the back cover 128 by screw(s).

Referring to FIG. 3 and FIG. 4, the cup frame 120 further includes a bottom shell 129 and a heat sink 1291. The heat sink 1291 is fixed to an end of the control portion 1212 away from the surface shell 126 by the bottom shell 129.

The refrigeration assembly 150 includes a heat dissipation element 151 and an exhaust fan 152. The heat dissipation element 151 is fixed to a side of the bottom shell 129 away from the frame body 121. The exhaust fan 152 is fixed to a side of the heat dissipation element 151 away from the bottom shell 129 by mounting part(s) 153. Wires of the heat dissipation element 151 and the exhaust fan 152 are fixed by the first crimping block 1281 and the second crimping block 1282 and are then electrically connected to the control unit 130.

The cup barrel 110 is provided therein with a carrying plate 111. The carrying plate 111 is used to carry the cup. The carrying plate 111 and the heat sink 1291 have a certain distance therebetween, so as to prevent the heat sink 1291 from damaging the carrying plate 111.

Figure 8:
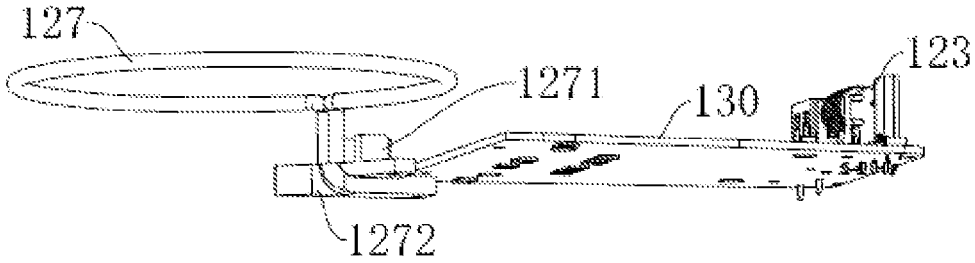
FIG. 8 shows a schematic diagram of connection between a light guide bar and a control unit according to an embodiment of the present disclosure.

Referring to FIG. 3 and FIG. 8, the cup frame 120 further includes a light guide bar 127. The light guide bar 127 is disposed between the surface shell 126 and the frame body 121. The light guide bar 127 is electrically connected to the control unit 130. When the roller 1231 is rotated to a second preset angle, the control unit 130 can control the light guide bar 127 to be lit up, in which case by pressing the roller 1231 downwards, on or off of the refrigeration assembly 150 can be controlled.

Specifically, the intelligent saucer 100 further includes a first pressing block 1271 and a second pressing block 1272. A connection portion of the light guide bar 127 is fixed between the first pressing block 1271 and the second pressing block 1272. The second pressing block 1272 is fixedly connected to the control unit 130, so that the light guide bar 127 is fixed between the surface shell 126 and the frame body 121.

The surface shell 126 is made of a transparent material.

When the intelligent saucer 100 according to the present embodiment is in use, by rotating the roller 1231 to different preset angles, corresponding components can be lit up, and lighting-up of different components can facilitate the user to control the operation of different functional assemblies. For example, when the first light-emitting assembly 124 and the second light-emitting assembly 125 are turned on, the user can be reminded that the operation of the wireless charging assembly 140 may be controlled at this time by pressing the roller 1231. When the light guide bar 127 is turned on after the roller 1231 is rotated to a certain angle, the user is reminded that the operation of the refrigeration assembly 150 may be controlled by pressing the roller 1231.

Preferably, the first light-emitting assembly 124 and the second light-emitting assembly 125 have the same color of light, and the light guide bar 127 has another color of light, thus, it is easy for the user to distinguish in darkness.

The intelligent saucer 100 further includes a mounting seat 160. The mounting seat 160 is embedded in an armrest of the furniture. The frame body 121 is fixedly connected to the mounting seat 160 through a snap-fitting structure, so that the intelligent saucer 100 is fixed on the furniture.

Figure 9:
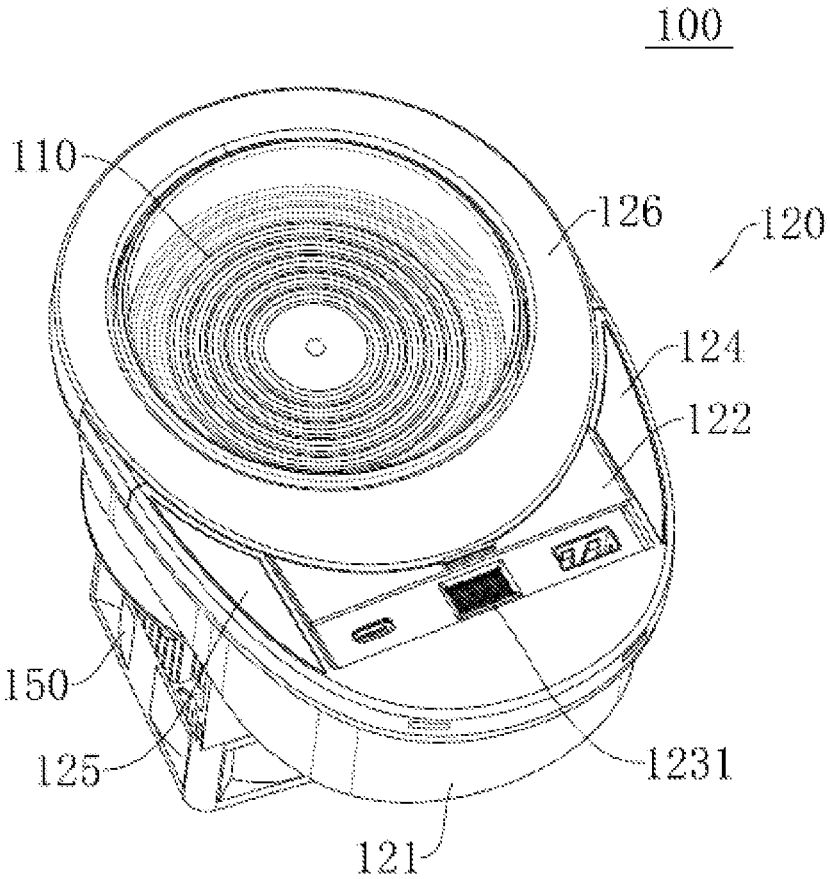
FIG. 9 shows a schematic diagram of the baffle plate, in the first operating state, of the intelligent saucer according to another embodiment of the present disclosure.

In some embodiments, referring to FIG. 9, the cup frame 120 has a relatively small length, so that the intelligent saucer 100 is placed on a furniture armrest of a corresponding size.

According to the intelligent saucer 100 provided in the present disclosure, the cup is carried by the cup barrel 110; and the refrigeration assembly 150 can cool the cup in the cup barrel 110. The baffle plate 122 can carry the electronic product, and the wireless charging assembly 140 can wirelessly charge the electronic product. By rotating the roller 1231, the encoder 139 on the control unit 130 can convert the angular displacement of the roller 1231 into the corresponding electrical signal, so that the control unit 130 controls the operation of the wireless charging assembly 140 or the refrigeration assembly 150. The baffle plate 122, slidably fitted with the frame body 121, can expose the roller 1231 in the first operating state, so as to facilitate the rotation of the roller 1231; and the baffle plate 122 can also shelter the roller 1231 in the second operating state, so as to prevent liquids and dust from entering the interior of the frame body 121, and avoid unintended activation of the roller 1231. With the intelligent saucer 100 of the present disclosure, the operation of different functional assemblies can be controlled by rotating the roller 1231, so that the operation is simple, and the users' use experience can be effectively improved.

Embodiment 2

Referring to FIG. 1 to FIG. 8, the present disclosure further provides a kind of furniture, including the above intelligent saucer 100.

The furniture may be a sitting device such as a sofa or a massage chair having armrest(s). The mounting seat 160 can be embedded in the armrest of the furniture, so that the intelligent saucer 100 is fixed on the armrest of the furniture.

The control unit 130 is electrically connected to a drive motor on the furniture. By rotating the roller 1231 to a certain angle and pressing the roller for confirmation, the control unit 130 can be made to control the drive motor to work, so that the furniture is turned on or off.

The furniture provided in the present embodiment has the intelligent saucer 100 provided in the above embodiment, therefore, it has all the beneficial effects of the intelligent saucer 100 provided in the above embodiment, which will not be elaborated herein.

In the description of the present description, descriptions with reference to the terms such as "an embodiment", "some embodiments", "example", "specific example", or "some examples" mean that specific features, structures, materials or characteristics described in combination with this embodiment or example are included in at least one embodiment or example of the present disclosure. In the present description, exemplary expressions of the above terms do not necessarily refer to the same embodiment or example. Moreover, the specific features, structures, materials or characteristics described can be combined in any appropriate manner in any one or more embodiments or examples. Besides, those skilled in the art could incorporate and combine different embodiments or examples described in the present description and features of different embodiments or examples, without contradiction.

Although the embodiments of the present disclosure are shown and described in the above, it could be understood that the above embodiments are exemplary, and should not be construed as limitation to the present disclosure. Those ordinarily skilled in the art could change, modify, substitute and vary the above embodiments within the scope of the present disclosure.

What is claimed is:

1. An intelligent saucer, comprising:

a cup barrel;

a cup frame, comprising a frame body, a roller, and a baffle plate, wherein the frame body is fixedly connected to the cup barrel; the roller is rotatably arranged on the frame body, and the roller is partially exposed outside the frame body; the baffle plate is slidably fitted with the frame body; and the baffle plate, within a movement stroke, has a first operating state of exposing the roller, and a second operating state of sheltering the roller;

a wireless charging assembly, fixed in the frame body;

a refrigeration assembly, fixed at one side of the frame body away from the cup barrel, and corresponding to the cup barrel; and a control unit, fixed in the frame body, and electrically connected to the wireless charging assembly and the refrigeration assembly respectively, wherein an encoder on the control unit is rotatably connected to the roller.

2. The intelligent saucer according to claim 1, wherein the frame body comprises a placement portion and a control portion connected to each other; the placement portion is provided with an accommodating cavity, and the cup barrel is fixed in the accommodating cavity; the roller is rotatably provided on the control portion, and the baffle plate is slidably fitted with the control portion.

3. The intelligent saucer according to claim 2, wherein a first slide strip and a second slide strip are respectively provided on the control portion; a first movement portion and a second movement portion are disposed at two sides of the baffle plate, respectively; and the first movement portion is slidably fitted with the first slide strip, and the second movement portion is slidably fitted with the second slide strip.

4. The intelligent saucer according to claim 3, wherein one end of the control portion away from the placement portion is provided with a rolling groove; and the roller is rotatably disposed in the rolling groove, and the roller is partially exposed outside the rolling groove.

5. The intelligent saucer according to claim 4, wherein the end of the control portion away from the placement portion is further provided with a slot, and the slot is corresponding to a charging jack on the control unit.

6. The intelligent saucer according to claim 1, wherein the intelligent saucer further comprises a first light-emitting assembly and a second light-emitting assembly; a first mounting groove and a second mounting groove are respectively provided on the frame body; the first light-emitting assembly is fixed in the first mounting groove, and the second light-emitting assembly is fixed in the second mounting groove; the baffle plate is located between the first light-emitting assembly and the second light-emitting assembly; and the control unit is electrically connected to the first light-emitting assembly, the second light-emitting assembly, and the wireless charging assembly, respectively.

7. The intelligent saucer according to claim 1, wherein the intelligent saucer further comprises a surface shell and a light guide bar; the surface shell is fixedly connected to the frame body; the light guide bar is provided between the surface shell and the frame body; and the control unit is electrically connected to the light guide bar and the refrigeration assembly respectively.

8. The intelligent saucer according to claim 7, wherein one end of the baffle plate close to the cup barrel is provided with a fitting portion corresponding to a peripheral shape of the surface shell; and the surface shell is provided thereon with a limiting portion corresponding to the fitting portion.

9. The intelligent saucer according to claim 8, wherein the intelligent saucer further comprises a first pressing block and a second pressing block; a connection portion of the light guide bar is fixed between the first pressing block and the second pressing block; and the second pressing block is fixedly connected to the control unit.

10. Furniture, comprising the intelligent saucer according to claim 1.

11. The intelligent saucer according to claim 2, wherein the intelligent saucer further comprises a first light-emitting assembly and a second light-emitting assembly; a first mounting groove and a second mounting groove are respectively provided on the frame body; the first light-emitting assembly is fixed in the first mounting groove, and the second light-emitting assembly is fixed in the second mounting groove; the baffle plate is located between the first light-emitting assembly and the second light-emitting assembly; and the control unit is electrically connected to the first light-emitting assembly, the second light-emitting assembly, and the wireless charging assembly, respectively.

12. The intelligent saucer according to claim 3, wherein the intelligent saucer further comprises a first light-emitting assembly and a second light-emitting assembly; a first mounting groove and a second mounting groove are respectively provided on the frame body; the first light-emitting assembly is fixed in the first mounting groove, and the second light-emitting assembly is fixed in the second mounting groove; the baffle plate is located between the first light-emitting assembly and the second light-emitting assembly; and the control unit is electrically connected to the first light-emitting assembly, the second light-emitting assembly, and the wireless charging assembly, respectively.

13. The intelligent saucer according to claim 4, wherein the intelligent saucer further comprises a first light-emitting assembly and a second light-emitting assembly; a first mounting groove and a second mounting groove are respectively provided on the frame body; the first light-emitting assembly is fixed in the first mounting groove, and the second light-emitting assembly is fixed in the second mounting groove; the baffle plate is located between the first light-emitting assembly and the second light-emitting assembly; and the control unit is electrically connected to the first light-emitting assembly, the second light-emitting assembly, and the wireless charging assembly, respectively.

14. The intelligent saucer according to claim 5, wherein the intelligent saucer further comprises a first light-emitting assembly and a second light-emitting assembly; a first mounting groove and a second mounting groove are respectively provided on the frame body; the first light-emitting assembly is fixed in the first mounting groove, and the second light-emitting assembly is fixed in the second mounting groove; the baffle plate is located between the first light-emitting assembly and the second light-emitting assembly; and the control unit is electrically connected to the first light-emitting assembly, the second light-emitting assembly, and the wireless charging assembly, respectively.

15. The intelligent saucer according to claim 2, wherein the intelligent saucer further comprises a surface shell and a light guide bar; the surface shell is fixedly connected to the frame body; the light guide bar is provided between the surface shell and the frame body; and the control unit is electrically connected to the light guide bar and the refrigeration assembly respectively.

16. The intelligent saucer according to claim 3, wherein the intelligent saucer further comprises a surface shell and a light guide bar; the surface shell is fixedly connected to the frame body; the light guide bar is provided between the surface shell and the frame body; and the control unit is electrically connected to the light guide bar and the refrigeration assembly respectively.

17. The intelligent saucer according to claim 4, wherein the intelligent saucer further comprises a surface shell and a light guide bar; the surface shell is fixedly connected to the frame body; the light guide bar is provided between the surface shell and the frame body; and the control unit is electrically connected to the light guide bar and the refrigeration assembly respectively.

18. The intelligent saucer according to claim 5, wherein the intelligent saucer further comprises a surface shell and a light guide bar; the surface shell is fixedly connected to the frame body; the light guide bar is provided between the surface shell and the frame body; and the control unit is electrically connected to the light guide bar and the refrigeration assembly respectively.

19. The intelligent saucer according to claim 15, wherein one end of the baffle plate close to the cup barrel is provided with a fitting portion corresponding to a peripheral shape of the surface shell; and the surface shell is provided thereon with a limiting portion corresponding to the fitting portion.

20. The intelligent saucer according to claim 16, wherein one end of the baffle plate close to the cup barrel is provided with a fitting portion corresponding to a peripheral shape of the surface shell; and the surface shell is provided thereon with a limiting portion corresponding to the fitting portion.

* * * * *